US006948987B2

(12) United States Patent
Fuse

(10) Patent No.: US 6,948,987 B2
(45) Date of Patent: Sep. 27, 2005

(54) PERSONAL WATERCRAFT

(75) Inventor: Tomohiro Fuse, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 165 days.

(21) Appl. No.: 10/660,440

(22) Filed: Sep. 10, 2003

(65) Prior Publication Data

US 2004/0116007 A1 Jun. 17, 2004

(30) Foreign Application Priority Data

Sep. 11, 2002 (JP) ..... 2002-266132

(51) Int. Cl.[7] ..... B63H 11/10
(52) U.S. Cl. ..... 440/42
(58) Field of Search ..... 440/40, 41, 42; 239/265.35

(56) References Cited

U.S. PATENT DOCUMENTS 3,658,026 A * 4/1972 Jacobson ..... 440/42
3,776,173 A * 12/1973 Horwitz ..... 440/42
3,957,207 A * 5/1976 Chronic ..... 239/265.35
4,252,075 A * 2/1981 Kobayashi ..... 440/42
5,551,898 A * 9/1996 Matsumoto ..... 440/41
5,803,775 A * 9/1998 Henmi ..... 440/42

FOREIGN PATENT DOCUMENTS

JP 9-281132 10/1997

* cited by examiner

*Primary Examiner*—Lars A. Olson
(74) *Attorney, Agent, or Firm*—Merchant & Gould P.C.

(57) ABSTRACT

A personal watercraft has a structure in which a steering nozzle is mounted onto a jet nozzle so as to be swingable vertically and in the left-right directions, upper and lower support shafts for mounting the steering nozzle include upper and lower bolts, the upper and lower bolts set such that the heads thereof are directed toward the jet nozzle, and the lengths of the upper and lower bolts are set such that the upper and lower bolts can be fastened to the steering nozzle when the heads of the upper and lower bolts come into contact with the jet nozzle.

18 Claims, 15 Drawing Sheets

PERSONAL WATERCRAFT

TECHNICAL FIELD

The present invention relates to a personal watercraft. In addition, the present invention relates to a personal watercraft including a steering nozzle provided on the rear side of a water jet propeller that can be swung in the left-right and vertical directions.

BACKGROUND

As a personal watercraft for planing on the waters of the sea and lakes, there is known, for example, a personal watercraft (see, for example, Japanese Patent Laid-open No. Hei 9-281132, FIG. 1). The personal watercraft includes an engine and a jet propeller driven by the engine which are disposed in a hull, and a steering nozzle provided at the rear end of the jet propeller. According to the personal watercraft, the jet propeller is driven by the engine, whereby an impeller of a water jet propeller is rotated, and water is sucked in through an intake port by the rotation of the impeller.

The water thus sucked in is ejected as jet water rearwards from the rear end of the steering nozzle, whereby the personal watercraft can be made to plane by the jet force of the jet water.

For steering the hull to the left and right directions during planing, the personal watercraft has a structure in which the steering nozzle can be swung in the left-right directions. Further, there is a personal watercraft in which the steering nozzle can be swung vertically for maintaining the hull in a favorable planing posture.

For ensuring that the steering nozzle can thus be swung in the left-right and vertical directions, an annular ring is disposed so as to cover the rear end of a jet propeller, left and right side portions of the ring are rotatably connected to the rear end of the jet propeller through left and right support shafts, a front end portion of the steering nozzle is disposed so as to cover the ring, and upper and lower end portions of the steering nozzle are rotatably connected to the ring through upper and lower support shafts.

Here, as the left and right support shafts and the upper and lower support shafts, bolts are generally used. These bolts are assembled in position, with their heads on the outside. Namely, the left and right bolts are inserted into left and right openings from the outside of the ring, and the bolts thus inserted are screw-engaged into threaded holes in the jet propeller, whereby the ring can be vertically swingably mounted onto the jet propeller.

Furthermore, the upper and lower bolts are inserted into upper and lower openings from the outside of the steering nozzle, and are inserted into upper and lower openings of the ring, whereby the upper and lower bolt tips are projected from the upper and lower openings of the ring, and nuts are screw-engaged with the upper and lower bolt tips thus projected, whereby the steering nozzle can be mounted onto the ring so as to be swingable in the left-right directions.

By this, the steering nozzle can be so mounted as to be swingable in the left-right and vertical directions relative to the jet propeller.

However, the nut screw-engaged with the tip end of the lower bolt might become slackened and disengaged from the lower bolt, for example when the personal watercraft is used for a long time. Thus, with the nut slackened, the lower bolt might be disengaged from the steering nozzle.

Therefore, it has been desired to put to practical use a steering nozzle mount structure in which the lower bolt would not become disengaged from the steering nozzle even if the nut should be slackened.

On the other hand, for swinging the steering nozzle vertically, an operating cable is generally connected to an upper portion of the steering nozzle through a joint. At the time of connecting the operating cable to the steering nozzle through the joint, first, the protrusion amount of the joint relative to the operating cable is adjusted to be appropriate.

Second, a mount hole of the joint is fitted over a mount bolt of the steering nozzle, and a nut is screw-engaged with the tip end of the mount bolt projected from the joint, whereby the operating cable is connected to the mount bolt.

After the operating cable is connected to the mount bolt, it is checked to determine whether or not the steering nozzle is mounted at a normal angle.

When the steering nozzle is not directed in the normal direction, the nut is disengaged from the mount bolt, and the steering nozzle is disengaged from the joint.

Subsequently, the joint disengaged from the steering nozzle is rotated relative to the operating cable, whereby the protrusion amount of the joint relative to the operating cable is again adjusted.

After the readjustment is over, a through-hole in the joint is again fitted over the mount bolt, and the nut is screw-engaged with the tip end of the mount bolt projected from the joint, whereby the operating cable is again connected to the mount bolt.

In this condition, it is again checked whether or not the steering nozzle is mounted at the normal angle. When the steering nozzle is mounted at the normal angle, the operation of connecting the operating cable to the steering nozzle is finished.

Thus, for readjusting the angle of the steering nozzle to a normal condition, the nut once screw-engaged with the mount bolt must be disengaged from the mount bolt. Therefore, it takes additional labor to adjust the direction of the steering nozzle to the normal angle.

Accordingly, it is an object of the present invention to provide a personal watercraft in which bolts can be so assembled as not to be disengaged from the steering nozzle even if nuts should be slackened and in which the direction of the steering nozzle can be adjusted to the normal angle without much labor at the time of assembly.

SUMMARY

In order to attain the above object, in one aspect according to the present invention a personal watercraft is provided which includes an engine and a jet propeller driven by the engine which are disposed in this order in a hull, a jet nozzle for ejecting jet water rearwards which is disposed on the rear side of the jet propeller, an annular trim ring mounted onto a rear portion of the jet nozzle with left and right support shafts so as to be vertically swingable, and a steering nozzle mounted onto the trim ring with upper and lower support shafts so as to be swingable in the left-right directions, whereby the steering nozzle is mounted onto the jet nozzle so as to be swingable vertically and in the left-right directions, wherein the upper and lower support shafts are bolts, the upper and lower bolts are so mounted that the heads thereof are directed toward the jet nozzle, and the length of the upper and lower bolts is so set that the upper and lower bolts can be fastened to the steering nozzle when the heads of the upper and lower bolts come into contact with the jet nozzle.

The upper and lower support shafts for swingably mounting the trim ring and the steering nozzle are constituted of bolts. In addition, the upper and lower bolts are so mounted that the heads thereof are directed toward the jet nozzle.

Further, the length of the upper and lower bolts is so set that the upper and lower bolts can be fastened to the steering nozzle when the heads thereof come into contact with the jet nozzle.

Therefore, even if the upper and lower bolts should become slackened, the heads of the upper and lower bolts can be prevented from being disengaged from the trim ring to the outside, and the upper and lower bolts can be prevented from being disengaged from the steering nozzle to the outside.

In accordance with another aspect of the present invention, a personal watercraft is provided which includes an engine and a jet propeller driven by the engine which are disposed in this order in a hull, a jet nozzle for ejecting jet water rearwards which is disposed on the rear side of the jet propeller, an annular trim ring mounted onto a rear portion of the jet nozzle with left and right support shafts so as to be vertically swingable, and a steering nozzle mounted onto the trim ring with upper and lower support shafts so as to be swingable in the left-right directions, whereby the steering nozzle is mounted onto the jet nozzle so as to be swingable vertically and in the left-right directions, wherein the jet nozzle is provided with a recessed portion for positioning, the trim ring is provided with a through-hole for positioning, and a positioning pin is inserted into the through-hole and the recessed portion, whereby the axis of the steering nozzle is made to coincide with the axis of the jet nozzle.

With the positioning pin inserted into the through-hole formed in the trim ring and the recessed portion formed in the jet nozzle, the steering nozzle can be fixed in a standard position where the axis of the steering nozzle is made to coincide with the axis of the jet nozzle.

Thus, the steering nozzle can be fixed in the standard position by a simple operation of inserting the positioning pin into the through-hole and the recessed portion, so that the length of an operating cable can be adjusted without much labor.

According to yet another aspect of the present invention, a personal watercraft is provided which includes an engine and a jet propeller driven by the engine which are disposed in this order in a hull, a jet nozzle for ejecting jet water rearwards which is disposed on the rear side of the jet propeller, an annular trim ring mounted onto a rear portion of the jet nozzle with left and right support shafts so as to be vertically swingable, and a steering nozzle mounted onto the trim ring with upper and lower support shafts so as to be swingable in the left-right directions, whereby the steering nozzle is mounted onto the jet nozzle so as to be swingable vertically and in the left-right directions, wherein an operating cable is provided for vertically swinging the steering nozzle, and a connection portion of the operating cable is attached to the upper support shaft erected on the trim ring so as to be capable of being fitted over and drawn out.

With the structure in which the connection portion can be attached to the upper support shaft erected on the trim ring so as to be capable of being fitted over and drawn out, the operating cable can be tentatively attached to the upper support shaft by simply fitting the connection portion over the upper support shaft.

By this, it is possible to check whether or not the length of the operating cable is normal, in the tentative attached condition where the connection portion is only fitted over the upper support shaft.

Therefore, in the case where the length of the operating cable must be readjusted, the connection portion can be easily disengaged from the upper support shaft.

DESCRIPTION OF THE DRAWINGS

An embodiment of the present invention will be described below. As used herein, the terms "front," "rear," "left" and "right" have the respective meanings as viewed from the driver.

DETAILED DESCRIPTION

Figure 1:
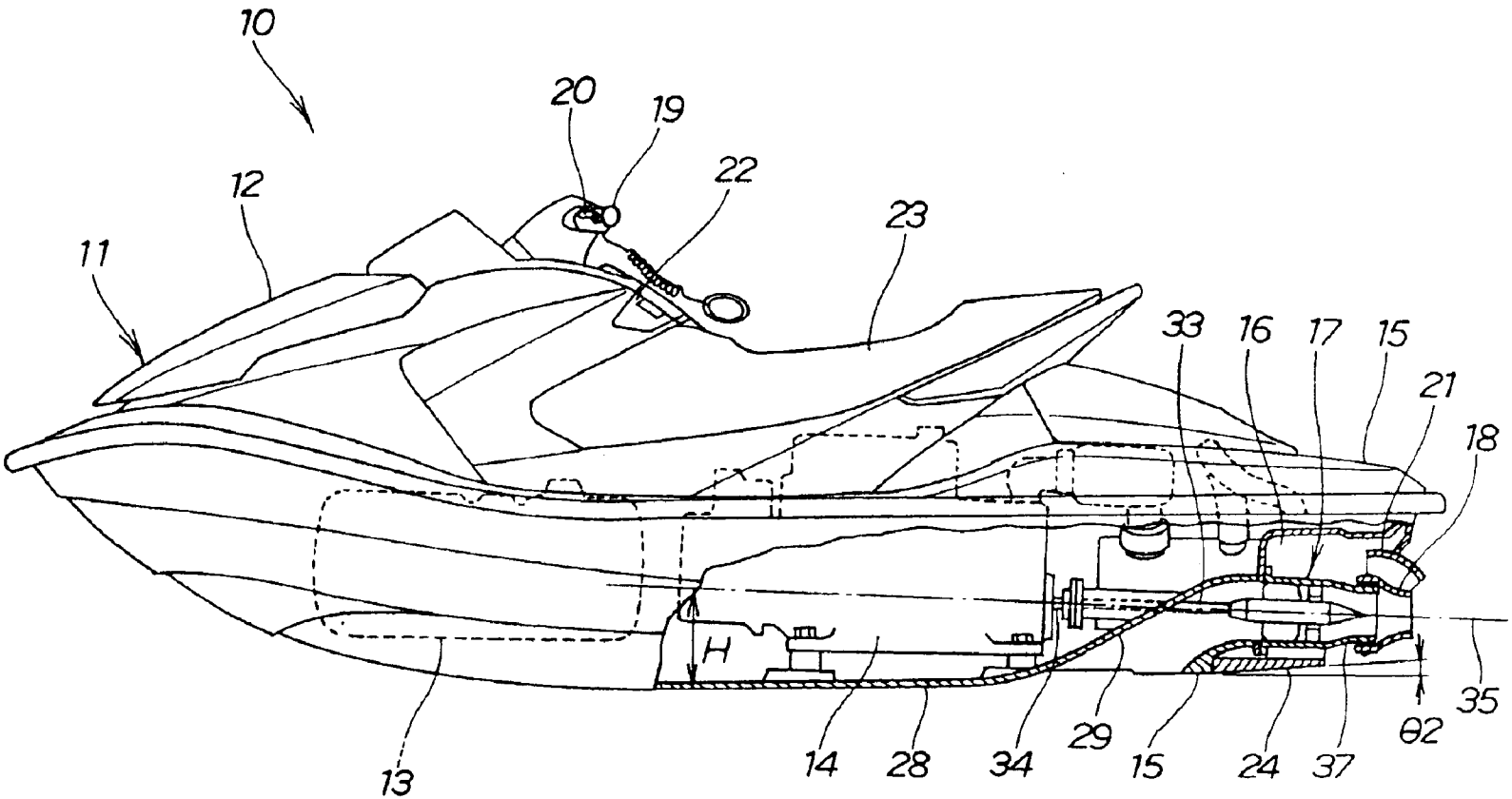
FIG. 1 is a side view of a personal watercraft according to the present invention.

FIG. 1 is a side view of a personal watercraft according to the present invention.

As shown in FIG. 1, the personal watercraft 10 has a structure in which a fuel tank 13 is provided at a front portion 12 of a hull 11, an engine 14 is provided on the rear side of the fuel tank 13, a jet propeller chamber 16 is provided at a stern 15 on the rear side of the engine 14, a water jet propeller (jet propeller) 17 is provided in the jet propeller chamber 16, a steering nozzle 18 is provided on the rear side of the water jet propeller 17, a steering handle 19 for swinging the steering nozzle 18 in the left-right directions is provided on the upper side of the fuel tank 13, a trim operating lever 20 for swinging the steering nozzle 18 vertically is provided on the steering handle 19, a reverse bucket 21 is provided on the rear side of the steering nozzle 18, a reverse operating lever 22 for swinging the reverse bucket 21 vertically is provided on the rear side of the steering handle 19, a seat 23 extending in the front-rear directions is provided on the rear side of the reverse operating lever 22, and a ride plate 24 is provided at a bottom surface of the stern 15 on the rear side of the seat 23.

Figure 2:
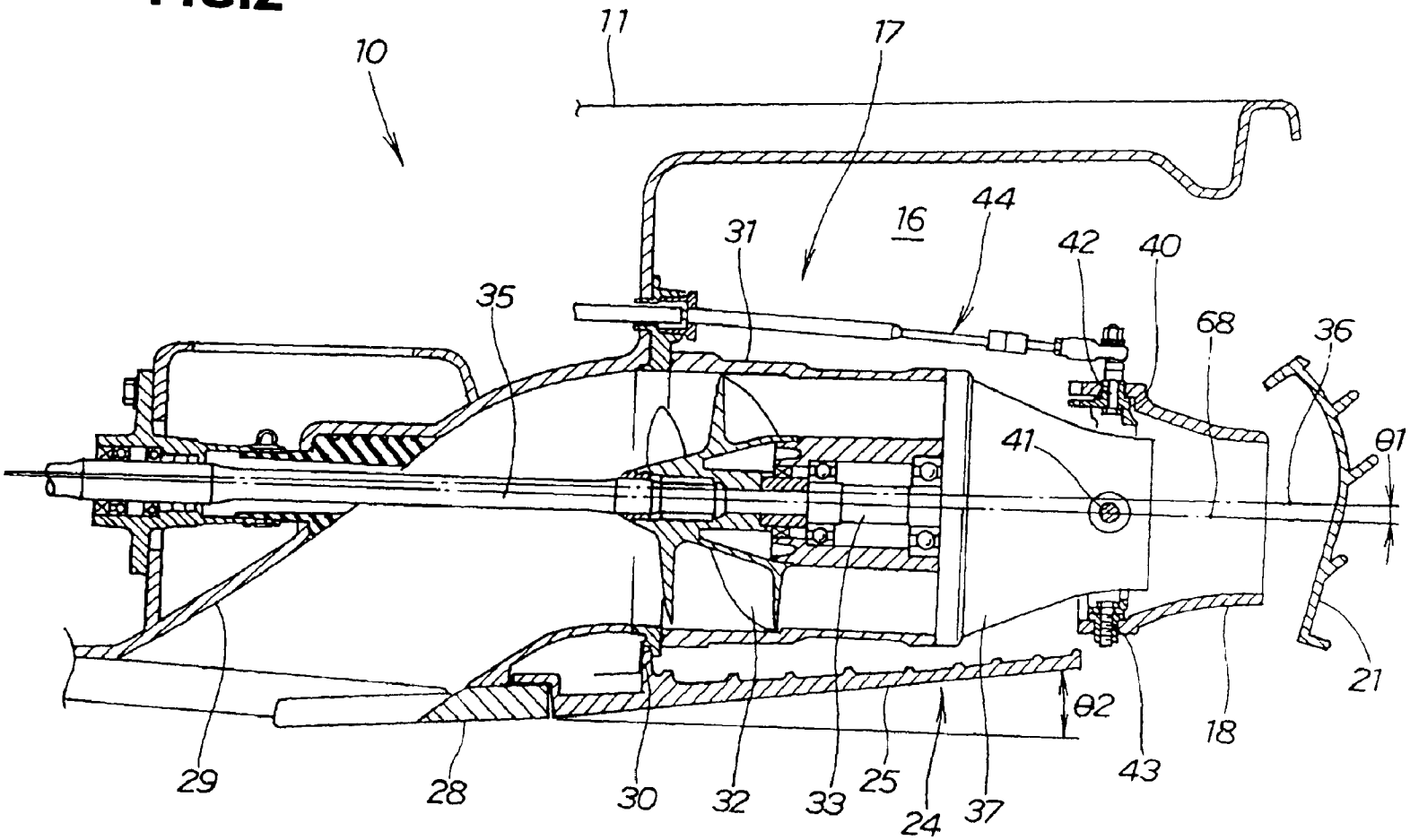
FIG. 2 is a sectional view of a part of the personal watercraft according to the present invention.

FIG. 2 is a sectional view of a part of the personal watercraft according to the present invention, and shows the condition where the reverse bucket 21 is disposed at a position on the rear side of the steering nozzle 18, namely, at a reverse position.

The water jet propeller 17 has a structure in which an intake port 29 is provided in a hull bottom 28 of the hull 11, the intake port 29 is extended to the water jet propeller chamber 16, a cylindrical stator 31 is provided in a wall portion 30 of the jet propeller chamber 16, an impeller 32 is rotatably disposed in the stator 31, and a drive shaft 34 (see FIG. 1) is connected to a shaft 33 of the impeller 32.

The water jet propeller 17 has its axis 35 (axis of jet nozzle) set with a downward gradient at an angle θ1 (see FIG. 1 also) toward the rear side of the hull 11 relative to a reference line 36 parallel to the horizontal line during planing.

The drive shaft 34 is a shaft for outputting the driving power of the engine 14, with its front end connected to the engine 14.

According to the personal watercraft 10, the impeller 32 can be rotated through rotation of the drive shaft 34 by the engine 14 shown in FIG. 1. Since the impeller 32 can be rotated, water can be taken in through the intake port 29 and led into the stator 31.

The water thus led in is passed through the rear end of the stator 31 and through the steering nozzle 18, to be jetted rearwards as water jet, whereby the personal watercraft 10 can be made to plane.

Here, the ground for setting the axis 35 of the water jet propeller 17 with the downward gradient at the inclination angle of θ1 toward the rear side of the hull 11 relative to the reference line 36 parallel to the horizontal line during planing will be described, referring back to FIG. 1.

It is necessary for the water jet propeller 17 to efficiently take in the water taken in through the intake port 29 and to efficiently jet the taken-in water as jet water. Therefore, it is preferable that the jet nozzle 37 at a rear portion of the water jet propeller 17 and the steering nozzle 18 mounted onto the jet nozzle 37 are disposed at positions close to the hull bottom 28, namely, at lower positions in the hull 11.

On the other hand, it is necessary for the engine 14 to have a certain degree of largeness, for securing an output necessary for driving the water jet propeller 17. Therefore, a crankshaft of the engine 14 (namely, the drive shaft 34 of the engine 14) is disposed at a somewhat high position H from the hull bottom 28.

Accordingly, it is necessary to set the jet nozzle 37 and the steering nozzle 18 on the lower side of the high position H, and the axis 35 of the water jet propeller 17 is set with the downward gradient at the angle θ1 toward the rear side of the hull 11 relative to the reference line 36 parallel to the horizontal line during planing.

Here, by constituting the steering nozzle 18 to be swingable vertically, the axis 68 of the steering nozzle 18 can be made to coincide with the axis 35 of the water jet propeller 17.

By this, jet water can be jetted downwards from the steering nozzle 18. Incidentally, the merits of the downward jetting of jet water from the steering nozzle 18 will be described in detail later, referring to FIG. 14(*a*).

Figure 4:
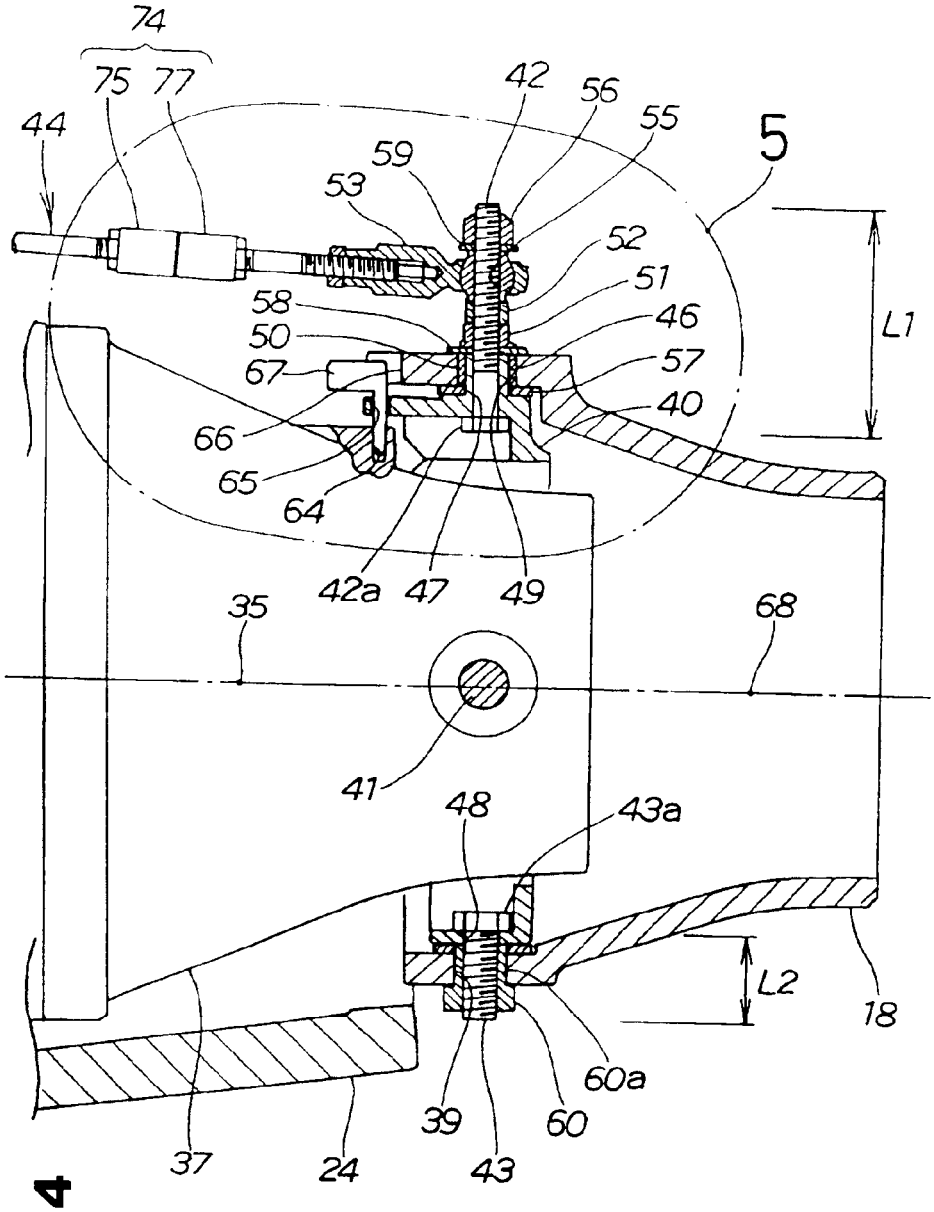
FIG. 4 is an enlarged sectional view of a part of the personal watercraft according to the present invention.

Returning to FIG. 2, the water jet propeller 17 has a structure in which a trim ring 40 is mounted onto the jet nozzle 37 at the rear end of the stator 31 with left and right support shafts (bolts) 41, 41 (the right-side one is shown in FIG. 4) so as to be vertically swingable, and the steering nozzle 18 is mounted onto the trim ring 40 with upper and lower support shafts (bolts) 42, 43 so as to be swingable in the left-right directions.

A trim operating cable (operating cable) 44 is connected to the steering nozzle 18 through the upper bolt 42, and the trim operating cable 44 is connected to a trim operating lever 20 (see FIG. 3) of the steering handle 19.

With this arrangement, the steering nozzle 18 can be vertically swung with the left and right bolts 41, 41 as a center, by operating the trim operating cable 44 with the trim operating lever 20.

Thus, by vertically swinging the steering nozzle 18 with the left and right bolts 41, 41 as a center, the planing posture of the hull 11 during planing of the personal watercraft 10 can be maintained favorably.

In addition, the personal watercraft 10 has a structure in which, of the bottom surface of the stern 15, the portion on the lower side of the water jet propeller 17 is constituted of the ride plate 24 which can be detached from the hull 11.

The ride plate 24 is fixed to the hull 11 with bolts (not shown). The bottom surface (the bottom surface of the stern) 25 of the ride plate 24 is set with an upward gradient at an angle θ2 toward the rear side of the hull 11 relative to the reference line 36 parallel to the horizontal line during planing.

Incidentally, the merits of setting the bottom surface 25 of the ride plate 24 with the upward gradient at the angle θ2 toward the rear side of the hull 11 relative to the reference line 36 parallel to the horizontal line during planing will be described in detail later, referring to FIG. 14(*b*).

Figure 3:
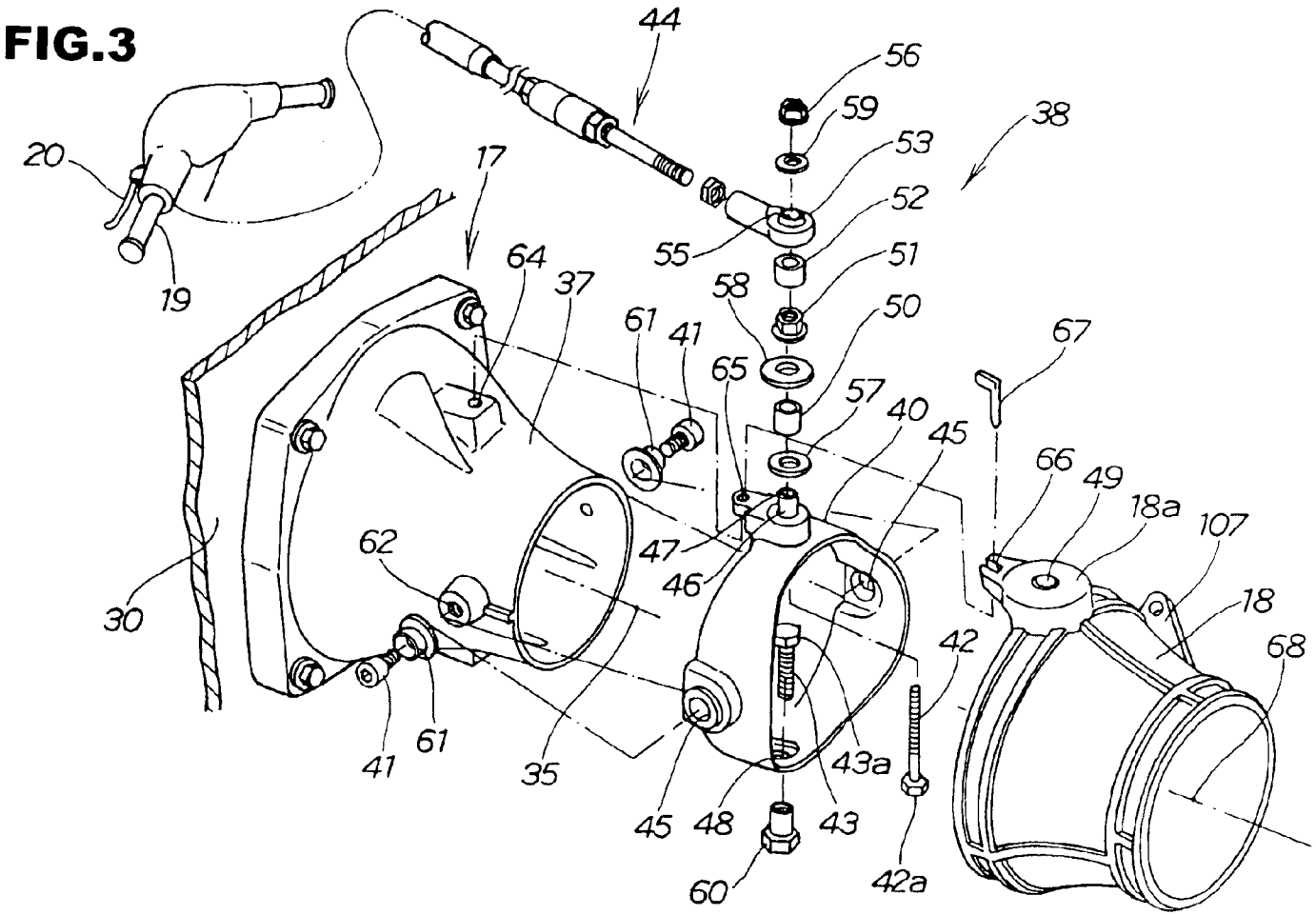
FIG. 3 is an exploded perspective view of a part of the personal watercraft according to the present invention.

FIG. 3 is an exploded perspective view of a part of the personal watercraft according to the present invention.

Referring to FIG. 3, a steering nozzle mount structure 38 constituting the personal watercraft 10 has a structure in which the trim ring 40 is mounted onto a rear portion of the jet nozzle 37 with the left and right support shafts (bolts) 41, 41 so as to be vertically swingable about the left and right bolts 41, 41, and the steering nozzle 18 is mounted onto the trim ring 40 with the upper and lower support shafts (bolts) 42 and 43 so as to be swingable about the upper and lower bolts 42 and 43, whereby the steering nozzle 18 is mounted onto the jet nozzle 37 so as to be swingable vertically and in the left-right directions.

The trim ring 40 is an annular member, left and right side mount holes 45, 45 are provided in left and right side portions of the trim ring 40, a shaft portion 46 is provided at an upper portion of the trim ring 40, the shaft portion 46 is provided with an upper mount hole 47 penetrating therethrough, and a lower mount hole 48 is provided in a lower portion of the trim ring 40.

The shaft portion 46 at the upper portion of the trim ring 40 is inserted into an upper mount hole 49 in the steering nozzle 18, and a collar 50 is inserted into the space between the upper mount hole 49 and the shaft portion 46. The upper bolt 42 is inserted into the upper mount hole 47 from the inside of the trim ring 40, a nut 51 is fastened to the upper bolt 42 protruding from an upper portion of the steering nozzle 37, and a spacer 52 is fitted over the upper bolt 42 protruding from the nut 51.

A mount hole 55 in a trim joint (connection portion) 53 is fitted over the upper bolt 42 protruding from the spacer 52, and a nut 56 is screw-engaged with the upper bolt 42 protruding from the trim joint 53.

Incidentally, a washer 57 is preferably disposed between the trim ring 40 and the steering nozzle 18, and a washer 58 is disposed between the upper end 18*a* of the steering nozzle 18 and the nut 51. Further, a washer 59 is disposed between the trim joint 53 and the nut 56.

In addition, the lower bolt 43 is inserted into the lower mount hole 48 in the trim ring 40 and the lower mount hole 39 (see FIG. 4) in the steering nozzle 18 from the inside, and a nut 60 is screw-engaged with the lower bolt 43 from the outside of the steering nozzle 18.

Therefore, the steering nozzle 18 can be mounted onto the trim ring 40 so as to be swingable in the left-right directions, with the upper and lower bolts 42 and 43 as an axis.

Left and right collars 61, 61 are fitted into the left and right side mount holes 45, 45 in the trim ring 40, the left and right bolts 41, 41 are inserted into the left and right collars 61, 61, and the tip ends of the bolts 41, 41 are screw-engaged with left and right threaded holes 62 (the threaded hole on the right side is not shown) in the jet nozzle 37.

Therefore, the trim ring 40 can be mounted onto the jet nozzle 37 so as to be swingable vertically, with the left and right bolts 41, 41 as an axis.

Thus, the trim ring 40 is mounted onto the jet nozzle 37 so as to be vertically swingable, and the steering nozzle 18 is mounted onto the trim ring 40 so as to be swingable in the left-right directions, whereby the steering nozzle 18 can be mounted to be swingable vertically and in the left-right directions relative to the jet nozzle 37.

The trim operating cable 44 is connected to the trim joint 53, and the trim operating cable 44 is connected to the trim operating lever 20 on the steering handle 19, whereby the steering nozzle 18 can be swung vertically with the left and right bolts 41, 41 as a center by operating the trim operating cable 44 by use of the trim operating lever 20.

In addition, the jet nozzle 37 is provided with a recessed portion for positioning (hereinafter referred to as "positioning recessed portion") 64, the trim ring 40 is provided with a through-hole 65 for positioning (hereinafter referred to as "positioning hole"), and the upper end of the steering nozzle 18 is provided with an insertion groove 66.

A positioning pin 67 is inserted through the insertion groove 66 into the positioning hole 65, and the tip end of the positioning pin 67 protruding from the positioning hole 65 is inserted into the positioning recessed portion 64, whereby the axis 68 of the steering nozzle 18 can be made to coincide with the axis of the jet nozzle 37, namely, the axis 35 of the jet propeller 17.

FIG. 4 is an enlarged sectional view of a part of the personal watercraft according to the present invention.

Referring to FIG. 4, the shaft portion 46 at the upper portion of the trim ring 40 is inserted into the upper mount hole 49 at the upper portion of the steering nozzle 18, the collar 50 is inserted into the space between the upper mount hole 49 and the shaft portion 46, the upper bolt 42 is inserted into the upper mount hole 47 in the trim ring 40 from the inside of the trim ring 40, and the nut 51 is screw-engaged with the upper bolt 42 protruding from the upper portion of the steering nozzle 18, whereby the upper bolt 42 is attached to the trim ring 40 and the steering nozzle 18.

After the upper bolt 42 is attached to the trim ring 40 and the steering nozzle 18, the spacer 52 is fitted over the upper bolt 42 protruding from the nut 51. The mount hole 55 in the trim joint 53 is fitted over the upper bolt 42 protruding from the spacer 52, and the nut 56 is screw-engaged with the upper bolt 42 protruding from the trim joint 52.

By this, the head (hereinafter referred to as "upper bolt head") 42*a* of the upper bolt 42 can be disposed to be directed toward the jet nozzle 37.

In addition, the length (upper bolt length) L1 of the upper bolt 42 is so set that, when the upper bolt 42 is slackened and the upper bolt head 42*a* comes into contact with the jet nozzle 37, the upper bolt 42 is prevented from being disengaged from the steering nozzle 18, i.e., the upper bolt 42 remains in the state of being fastened to the steering nozzle 18.

Therefore, even if the upper bolt 42 should be slackened, the upper bolt 42 can be prevented from slipping out of the upper mount hole 47, and the upper bolt 42 can be prevented from dropping.

In addition, the lower bolt 43 is inserted into the lower mount hole 48 in the trim ring 40 and the lower mount hole 39 in the steering nozzle 18 from the inside, and the nut 60 is screw-engaged with the lower bolt 43 from the outside of the steering nozzle 18.

A shaft portion 60*a* of the nut 60 can be inserted into the lower mount hole 39 in the steering nozzle 18.

With the lower bolt 43 inserted from the inside of the trim ring 40, the head (hereinafter referred to as "lower bolt head") 43*a* of the lower bolt 43 can be disposed to be directed toward the jet nozzle 37.

In addition, the length (lower bolt length) L2 of the lower bolt 43 is so set that, when the lower bolt 43 is slackened and the lower bolt head 43*a* comes into contact with the jet nozzle 37, the lower bolt 43 is prevented from being disengaged from the steering nozzle 18, i.e., the lower bolt 43 remains in the state of being fastened to the steering nozzle 18.

Therefore, even if the lower bolt 43 should become slackened, the lower bolt 43 can be prevented from dropping.

Incidentally, since the lower bolt head 43*a* is located on the upper side, the lower bolt 43 can be prevented from dropping, even if the length (lower bolt length) L2 of the lower bolt 43 is not so set that, when the lower bolt 43 is slackened and the lower bolt head 43*a* comes into contact with the jet nozzle 37, the lower bolt 43 is prevented from being disengaged from the steering nozzle 18, i.e., the lower bolt 43 remains in the state of being fastened to the steering nozzle 18.

In addition, at the time of mounting the trim ring 40 and the steering nozzle 18 onto the jet nozzle 37, particularly at the time of adjusting the length of the trim operating cable 44, the positioning pin 67 is inserted through the insertion groove 66 into the positioning hole 65, and the tip end of the positioning pin 67 protruding from the positioning hole 65 is inserted into the positioning recessed portion 64.

By this, the axis 68 of the steering nozzle 18 can be made to coincide with the axis of the jet nozzle 37, namely, the axis 35 of the water jet propeller 17. Therefore, the direction of the steering nozzle 18 can be fixed in a standard position.

In this condition, the length of the trim operating cable 44 is adjusted, and after the adjustment of the length of the trim operating cable 44 is completed, the positioning pin 67 is drawn out of the positioning hole 65 and the positioning recessed portion 64.

Figure 5:
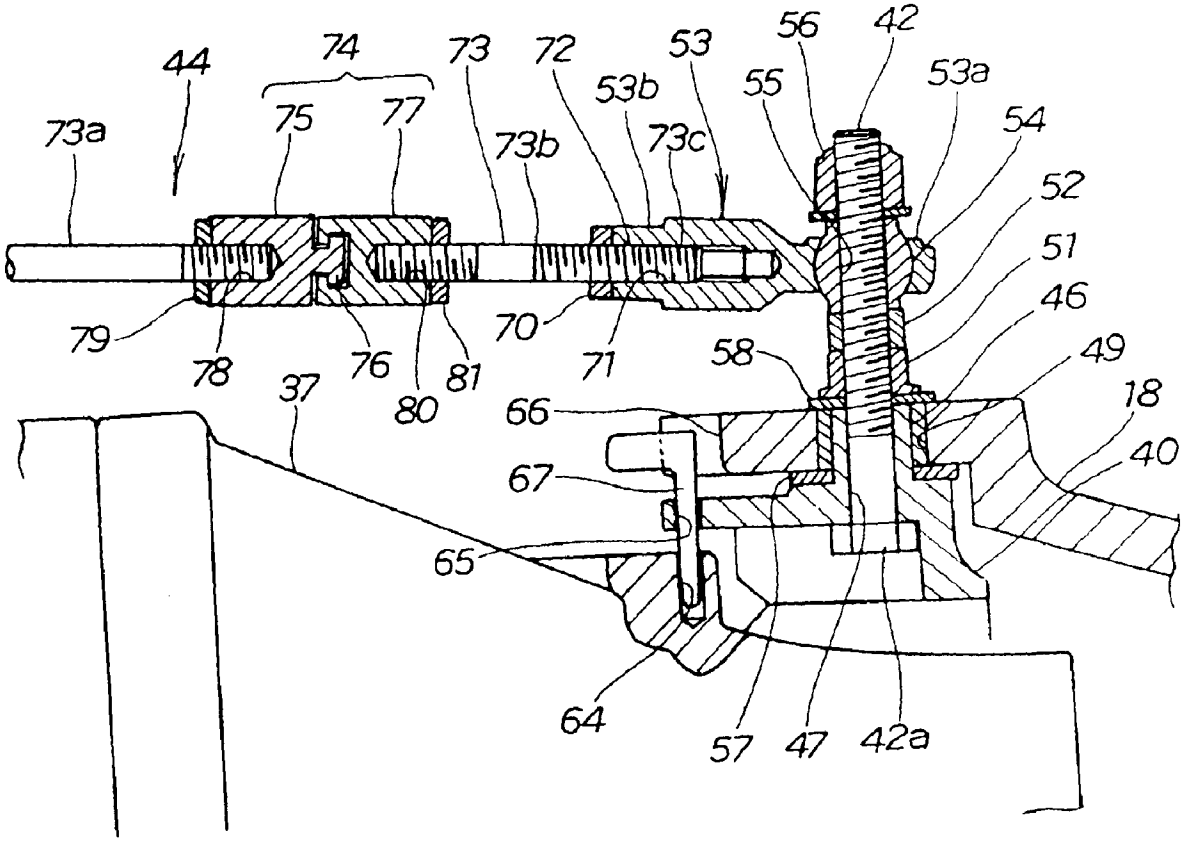
FIG. 5 is an enlarged view of part 5 of FIG. 4.

FIG. 5 is an enlarged view of part 5 of FIG. 4.

Referring to FIG. 5, the upper bolt 42 is inserted into the upper mount hole 47 from the inside of the trim ring 40, the washer 58 is fitted over the upper bolt 42 protruding from the upper portion of the steering nozzle 18, and the nut 51 is fastened from the upper side of the washer 58, whereby the upper bolt 42 can be fixed to the trim ring 40 and the steering nozzle 18.

The trim joint 53 attached to the upper bolt 42 includes a ball 54 in a turnable state at a head portion 53*a* thereof, and the ball 54 can be mounted onto the upper bolt 42 by fitting a mount hole 55 in the ball 54 over the upper bolt 42.

By this, a neck portion 53*b* can be swung in any direction relative to the ball 54.

A screw portion formed at the rear end 72 of the trim operating cable 44 is screw-engaged into a threaded hole 71 formed in the neck portion 53*b*. Namely, the trim operating cable 44 includes a rod portion 73 at a rear end portion thereof, the screw portion formed at the rear end 72 of the rod portion 73 is screw-engaged into the threaded hole 71 in the neck portion 53*b*, and the screw portion is fastened with a lock nut 70. By this, the upper bolt 42 can be connected to the trim operating cable 44.

Thus, by connecting the trim operating cable 44 by utilizing the upper bolt 42, the structure can be simplified.

A joint means 74 is provided at an intermediate portion of the rod portion 73, whereby the rod portion 73 is divided into a front rod 73*a* and a rear rod 73*b*. The joint means 74 includes a front joint portion 75 which is provided with a flange 76 at the rear end thereof via a projection, and a rear joint portion 77 rotatably connected to the flange 76.

A rear-end screw of the front rod 73*a* is screw-engaged into a threaded hole 78 formed in the front joint portion 75 and is fastened with a lock nut 79, whereas a front-end screw of the rear rod 73*b* is screw-engaged into a threaded hole 80 formed in the rear joint portion 77 and is fastened with a lock nut 81. By this, the front and rear rods 73*a* and 73*b* can be connected to each other through the joint means 74.

Thus, the upper bolt 42 is fixed to the trim ring 40 and the steering nozzle 18, and the trim joint 53 is connected to the upper bolt 42. Therefore, at the time of readjusting the length of the trim operating cable 44 after once fitting the trim joint 53 onto the upper bolt 42, the trim joint 53 is drawn out from the upper bolt 42, the lock nut 70 is slackened, and the connection length of the connection between a screw portion 73*c* of the front rod 73*a* constituting the rod 73 and the threaded hole 71 in the neck portion 53*b* is adjusted.

By this, the length of the so-called trim operating cable 44 can be adjusted.

With the trim joint 53 thus capable of being fitted over and drawn out from the upper bolt 42 erected on the trim ring 40, the trim operating cable 44 can be tentatively fastened to the upper bolt 42 by simply fitting the trim joint 53 over the upper bolt 42.

By this, in the tentative fastened condition in which the trim joint 53 is simply fitted over the upper bolt 42, it is possible to check whether or not the length of the trim operating cable 44 is normal.

Therefore, where it is necessary to readjust the length of the trim operating cable 44, it is possible to easily disengage the trim joint 53 from the upper bolt 42.

Accordingly, the length of the trim operating cable 44 can be easily readjusted by drawing out the trim joint 53 from the upper bolt 42.

In addition, by intermediately providing the joint means 74 at an intermediate portion of the rod portion 73, the trim joint 53 can be rotated arbitrarily. Therefore, when the length of the trim operating cable 44 is adjusted by slackening the lock nut 70 of the trim joint 53 and rotating the trim joint 53 so as to change the protrusion amount of the trim joint 53, for example, the mount hole 55 in the ball 54 of the trim joint 53 may come out of registration with the axis of the upper bolt 42.

In this case, the mount hole 55 in the ball 54 can be brought into registration with the axis of the upper bolt 42 by rotating the rear joint portion 77 of the joint means 74.

Next, the reverse bucket 21 (see FIGS. 1 and 2) will be described.

Figure 6:
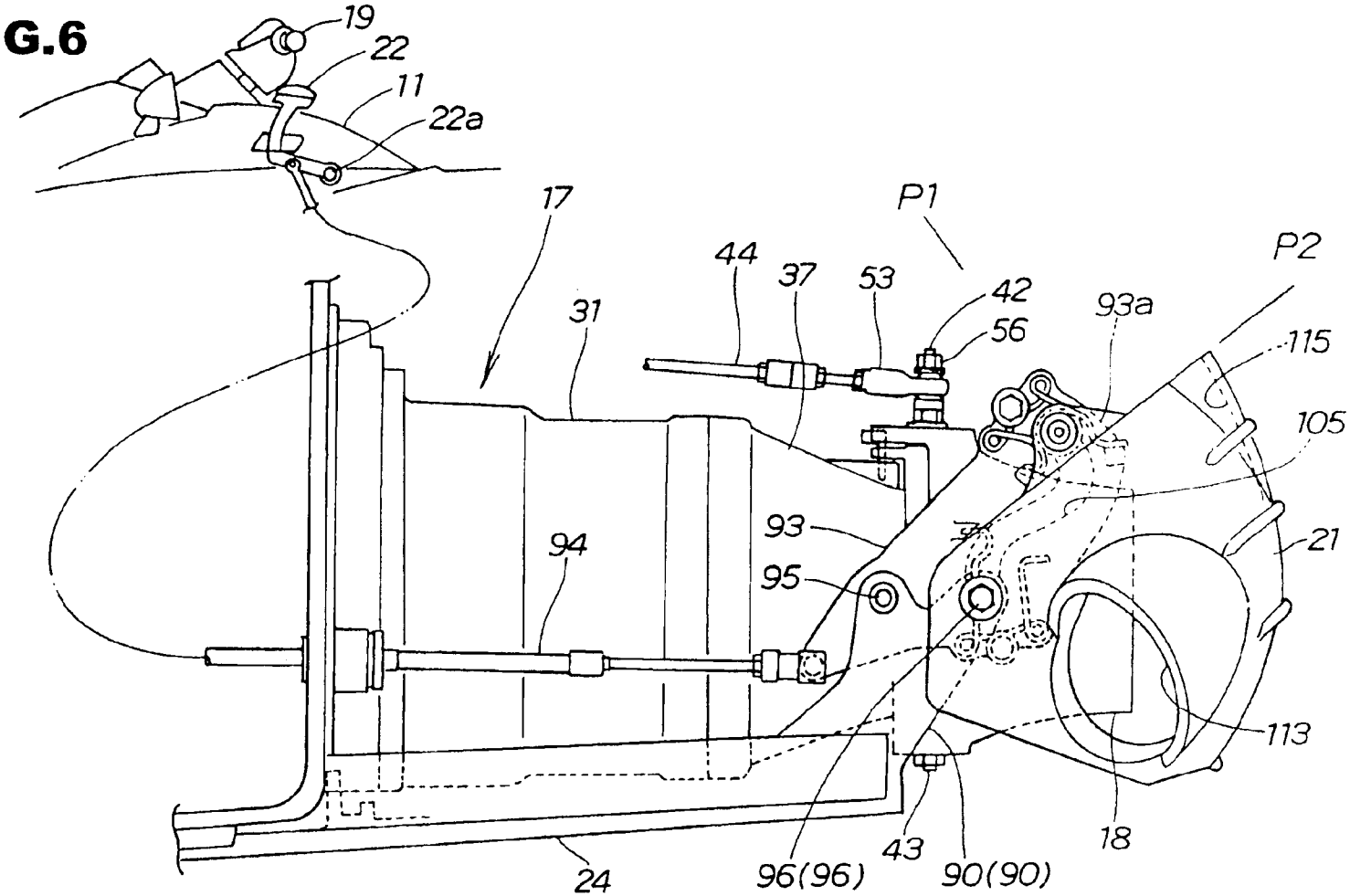
FIG. 6 is a side view of a part of the personal watercraft according to the present invention.

FIG. 6 is a side view of a part of the personal watercraft according to the present invention.

Referring to FIG. 6, left and right support brackets 90 and 91 (for the right support bracket, see also FIG. 7) are provided respectively on the left and right sides of the ride plate 24, and the reverse bucket 21 is mounted onto the left and right support brackets 90 and 91 so as to be vertically swingable.

An intermediate lever 93 is disposed in a gap 92 (see FIG. 7) between the left support bracket 90 and the steering nozzle 18, and the intermediate lever 93 is swingably mounted onto the left support bracket 90. A reverse operating cable 94 is connected to the reverse bucket 21 through the intermediate lever 93, and the reverse cable 94 is attached to the reverse operating lever 22.

By vertically swinging the reverse operating lever 22 with a support shaft 22*a* as a center, the reverse operating cable 94 is operated to thereby swing the intermediate lever 93 with a support bolt 95 as an axis.

With the intermediate lever 93 swung, the reverse bucket 21 can be vertically swung with left and right support bolts 96, 96 (for the right support bolt, see also FIG. 7) as an axis.

By this, the reverse bucket 21 can be moved to a forward position P1 on the upper side of the steering nozzle 18 and a reverse position P2 (the position shown) on the rear side of the steering nozzle 18.

Figure 7:
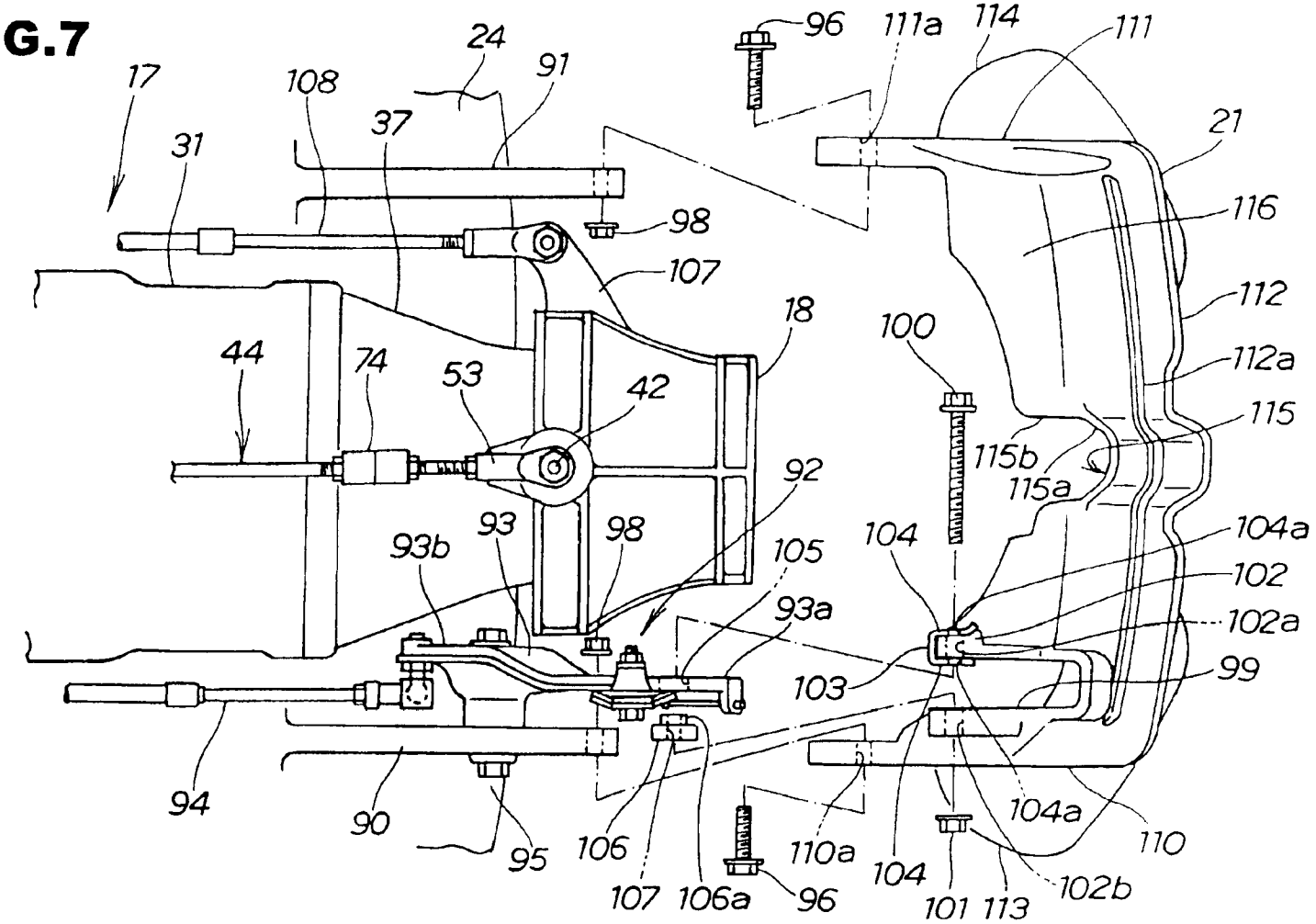
FIG. 7 is a plan view of a part of the personal watercraft according to the present invention.

FIG. 7 is a plan view of a part of the personal watercraft according to the present invention.

Referring to FIG. 7, the left and right support brackets 90 and 91 are provided on the left and right sides of the ride plate 24, namely, on the left and right sides of the steering nozzle 18, the reverse bucket 21 is vertically swingably mounted onto the left and right support brackets 90 and 91 with the left and right support bolts 96, 96 and nuts 98, 98, a containing pocket 99 is formed at a left end portion of the reverse bucket 21, an upper end portion 93*a* of the intermediate lever 93 is inserted into the containing pocket 99, and the intermediate lever 93 thus inserted is mounted onto the reverse bucket 21 with a mount bolt 100 and a nut 101.

At the time of mounting the upper end portion 93*a* of the intermediate lever 93 onto the containing pocket 99 of the reverse bucket 21 with the mount bolt 100 and the nut 101, a washer clip 103 (see FIG. 8 also) is fitted over a boss 102 of the containing pocket 99.

The washer clip 103 is roughly U-shaped, and its two pieces 104, 104 opposed to each other are provided with through-holes 104*a*, 104*a*.

The washer clip 103 is fitted over the boss 102 of the reverse bucket 21, and the through-holes 104*a*, 104*a* in the washer clip 103 are put into registration with a mount hole 102*a* in the boss 102.

A projection 106*a* on a slide member 106 is slideably fitted into a guide groove 105 (see FIG. 6 also) in he intermediate lever 93. A mount hole 107 in the slide member 106 is put into registration with mount holes 102*a* and 102*b* in the containing pocket 99.

A mount bolt 100 is inserted into the mount holes 102*a*, 107 and 102*b*, and a nut 101 is screw-engaged with a tip portion of the mount bolt 100.

The intermediate lever 93 can be mounted to the mount holes 102*a* and 102*b* in the containing pocket 99 with the mount bolt 100.

Thus, with the washer clip 103 fitted over the boss 102 of the reverse bucket 21, the conventional operation of holding a washer by hand at the time of assembly is unnecessary.

Therefore, simplification of the assembling operation is accomplished, and the intermediate lever 93 can be easily assembled in a short time.

After the intermediate lever 93 is thus disposed between the left support bracket 90 and the steering nozzle 18, the intermediate lever 93 is swingably mounted onto the left support bracket 90 with the support bolt 95.

Then, the reverse operating cable 94 is connected to a lower end portion 93*b* of the intermediate lever 93, whereby the reverse cable 94 is disposed along a left side wall of the stator 31.

By operating the reverse operating cable 94 with the reverse operating lever 22 (see FIG. 6), the reverse bucket 21 can be vertically swung with the left and right support bolts 96, 96 as an axis.

The reverse bucket 21 has a structure in which a curved rear wall 112 is bridgingly connected to left and right side walls 110 and 111, the left and right side walls 110 and 111 are provided respectively with left and right jet ports 113 and 114, the left and right side walls 110 and 111 are provided with mount holes 110*a* and 111*a* for mounting onto the left and right support brackets 90 and 91, and the containing pocket 99 is provided with the mount holes 102*a* and 102*b* for mounting of the intermediate lever 93.

The personal watercraft 10 (see FIG. 1) has a structure in which, for vertically swinging the steering nozzle 18 with the left and right bolts 41, 41 (see FIG. 3) as an axis, the upper bolt 42 is attached to an upper end portion of the steering nozzle 18, and the trim operating cable 44 is attached to the upper bolt 42 through the trim joint 53 and disposed along an upper portion of the stator 31.

A roughly central portion of the reverse bucket 21 is located on the rear side of these members, namely, the upper bolt 42, the trim joint 53 and the trim operating cable 44.

Therefore, at the time of raising the reverse bucket 21 to the forward position P1 (see FIG. 6), a central portion of the rear wall 112 of the reverse bucket 21 may interfere with these members (the upper bolt 42, the trim joint 53 and the trim operating cable 44).

Taking this into account, a connection portion containing recessed portion 115 for avoiding the interference with these members (the upper bolt 42, the trim joint 53 and the trim operating cable 44) is provided in a center portion 112*a* of the rear wall 112 of the reverse bucket 21.

The connection portion containing recessed portion 115 includes a roughly curved containing groove 115*a* gradually projecting rearwards from the rear wall 112, specifically from the central portion 112*a* toward the upper end 112*b* of the rear wall 112, and a cutout 115*b* formed at the center of a bent portion 116 of the rear wall 112, namely, at a position corresponding to the containing groove 115.

Incidentally, an arm 107 is extended outwardly from the right side wall of the steering nozzle 18, and a steering operating cable 108 is disposed on the arm 107 and along the right side wall of the stator 31.

By operating the steering operating cable 108 with the steering handle 19 (see FIG. 1), the steering nozzle 18 can be swung in the left-right directions with the upper and lower bolts 42 and 43 (for the lower bolt 43, see FIG. 4) as an axis.

Figure 8:
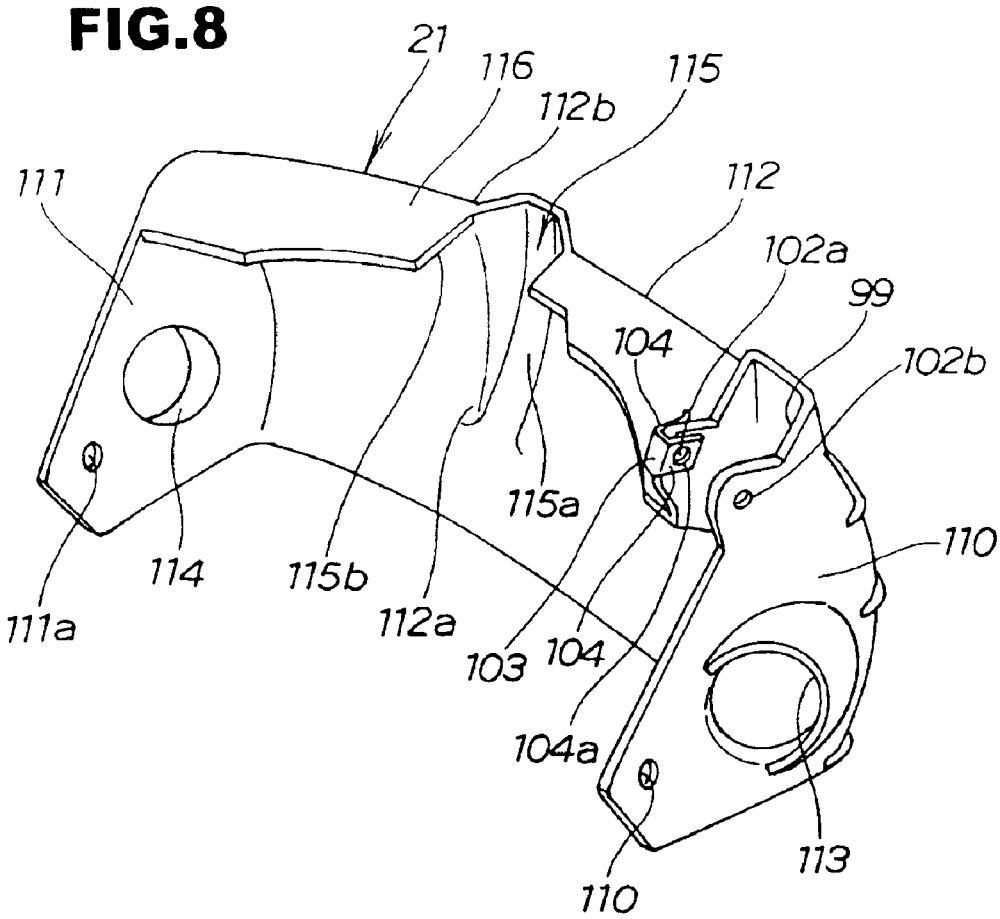
FIG. 8 is a perspective view of a reverse bucket of the personal watercraft according to the present invention.

FIG. 8 is a perspective view of the reverse bucket of the personal watercraft according to the present invention. Referring to FIG. 8, the connection portion containing recessed portion 115 will be described in detail.

The connection portion containing recessed portion 115 includes the containing groove 115*a* formed in the rear wall 112, and the cutout 115*b* formed at the upper end of the containing groove 115*a* to thereby open the upper end of the containing groove 115*a*.

The containing groove 115*a* is a groove extended roughly vertically so as to have a gradually increasing groove depth, from the center in the left-right directions of the rear wall 112 and the rough center 112*a* in the vertical direction of the rear wall 112 toward the upper end 112*b* of the rear wall 112.

In addition, the cutout 115*b* is formed at the center of the bent portion 116 formed at the upper end of the rear wall 112, i.e., the cutout 115*b* is formed at a position corresponding to the containing groove 115*a*.

With the cutout 115*b* thus formed at the center of the bent portion 116, the upper end of the containing groove 115*a* can be opened.

Next, the process of assembling the steering nozzle of the personal watercraft will be described based on FIGS. 9 to 12.

Figure 9A:
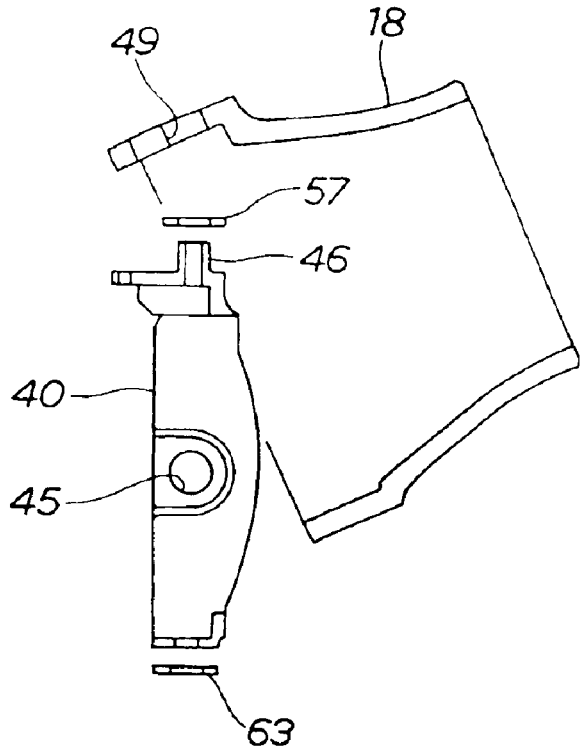
FIG. 9 is a first assembly step view for illustrating the process of assembling a steering nozzle onto a jet nozzle, in the personal watercraft according to the present invention.
Figure 9B:
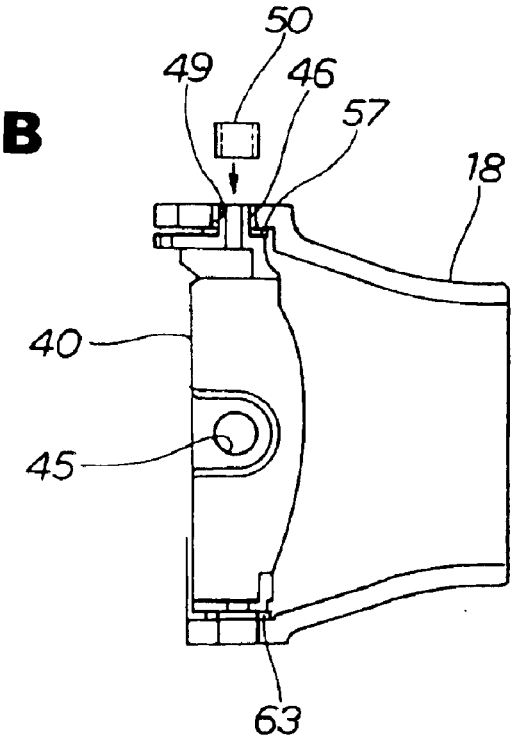

FIGS. 9(*a*) and (*b*) are first assembly step views for illustrating the process of assembling the steering nozzle onto the jet nozzle, in the personal watercraft according to the present invention.

In FIG. 9(*a*), the washer 57 is fitted over the shaft portion 46 at the upper end of the trim ring 40, and a washer 63 is set at the lower end of the trim ring 40. In this condition, the shaft portion 46 of the trim ring 40 is inserted into the upper mount hole 49 in the steering nozzle 18.

In FIG. 9(*b*), the shaft portion 46 of the trim ring 40 is inserted into the upper mount hole 49 in the steering nozzle 18. Next, the collar 50 is inserted into the gap between the shaft portion 46 of the trim ring 40 and the steering nozzle 18.

By this, the trim ring 40 can be contained in the front end of the steering nozzle 18.

Figure 10A:
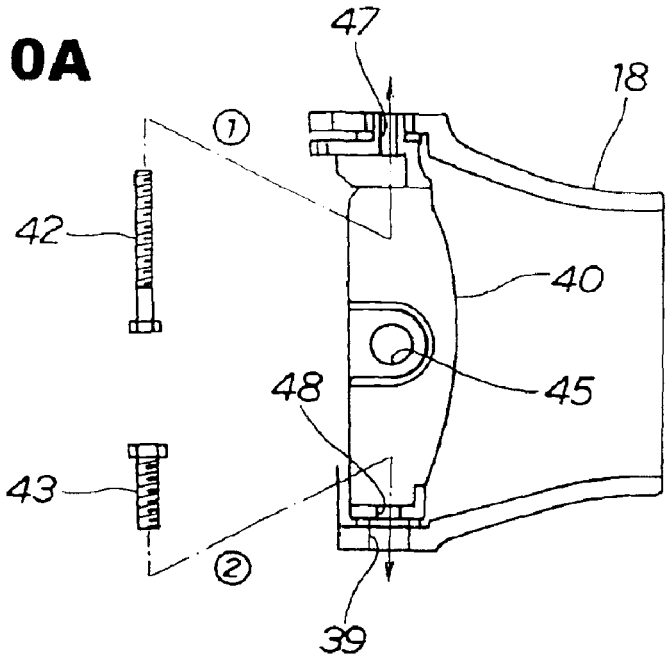
FIG. 10 is a second assembly step view for illustrating the process of assembling the steering nozzle onto the jet nozzle, in the personal watercraft according to the present invention.
Figure 10B:
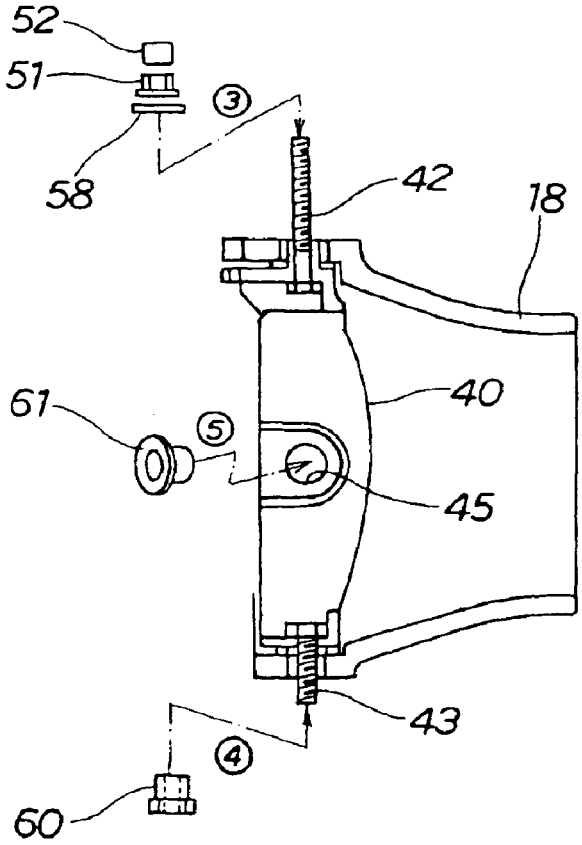

FIGS. 10(*a*) and (*b*) are second assembly step views for illustrating the process of assembling the steering nozzle onto the jet nozzle, in the personal watercraft according to the present invention.

In FIG. 10(*a*), the upper bolt 42 is inserted into the upper mount hole 47 at the upper end of the trim ring 40 from the inside of the trim ring as indicated by arrow (1). Next, the lower bolt 43 is inserted into the lower mount hole 48 at the lower end of the trim ring and the lower mount hole 39 at a lower portion of the steering nozzle 18 from the inside of the trim ring as indicated by arrow (2).

In FIG. 10(*b*), the washer 58 is fitted over the upper bolt 42 protruding from the upper end of the steering nozzle 18 as indicated by arrow (3), and the nut 51 is screw-engaged from the upper side thereof. By this, the upper end of the trim ring 40 and the upper end of the steering nozzle 18 can be connected through the upper bolt 42.

After the nut 51 is screw-engaged with the upper bolt 42, the spacer 52 is fitted over the upper bolt 42 protruding from the nut.

Next, the nut 60 is screw-engaged with the lower bolt 43 as indicated by arrow (4), whereby the lower end of the trim ring 40 and the lower end of the steering nozzle 18 can be connected through the lower bolt 43.

By this, the trim ring 40 can be connected to the steering nozzle 18 with the upper bolt 42 and the lower bolt 43.

Subsequently, the collars 61, 61 are inserted into the left and right side mount holes 45, 45 (the side mount hole on this side is not shown) in the trim ring 40 from the inside of the trim ring 40 as indicated by arrow (5).

Figure 11A:
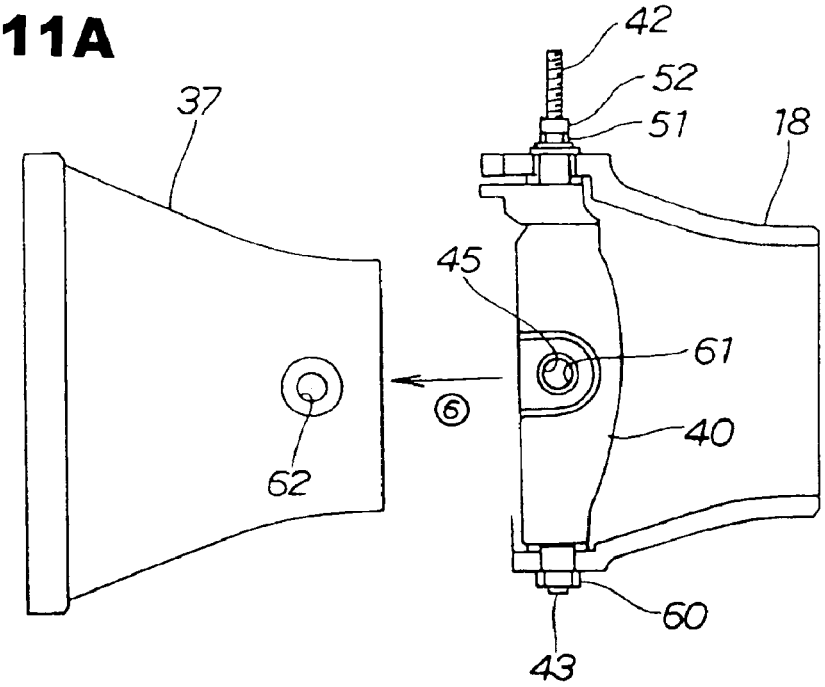
FIG. 11 is a third assembly step view for illustrating the process of assembling the steering nozzle onto the jet nozzle, in the personal watercraft according to the present invention.
Figure 11B:
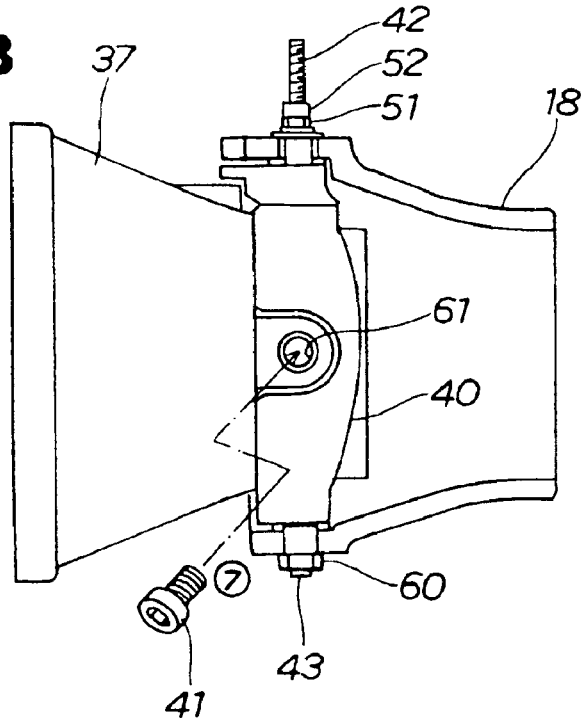

FIGS. 11(*a*) and (*b*) are third assembly step views for illustrating the process of assembling the steering nozzle onto the jet nozzle, in the personal watercraft according to the present invention.

In FIG. 11(*a*), in the condition where the trim ring 40 is connected to the steering nozzle 18 through the upper bolt 42 and the lower bolt 43, the trim ring 40 is fitted over the rear end of the jet nozzle 37 as indicated by arrow (6).

In FIG. 11(*b*), the left and right bolts 41, 41 are inserted respectively into the left and right collars 61, 61 as indicated by arrow (7).

Figure 12A:
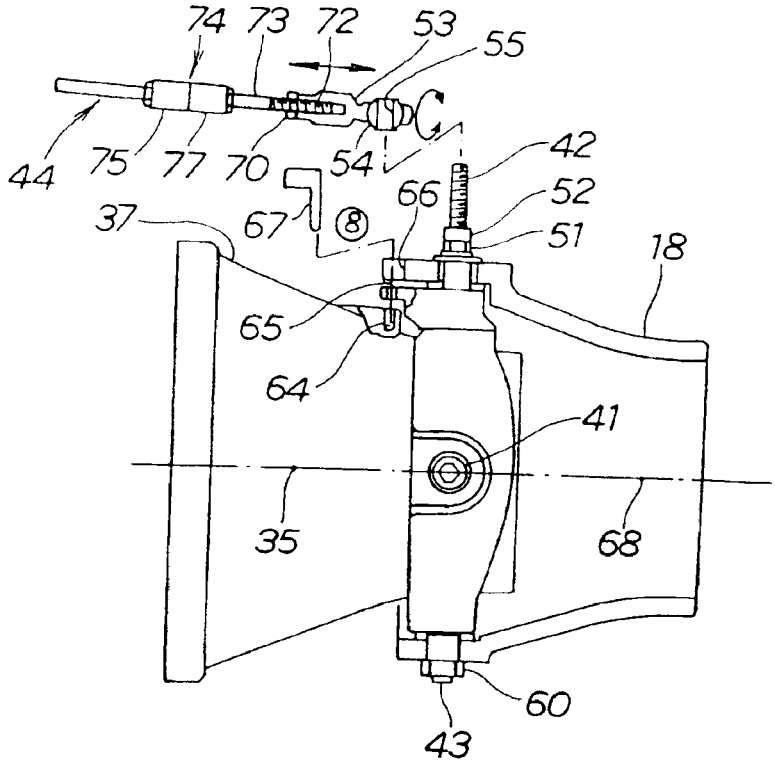
FIG. 12 is a fourth assembly step view for illustrating the process of assembling the steering nozzle onto the jet nozzle, in the personal watercraft according to the present invention.
Figure 12B:
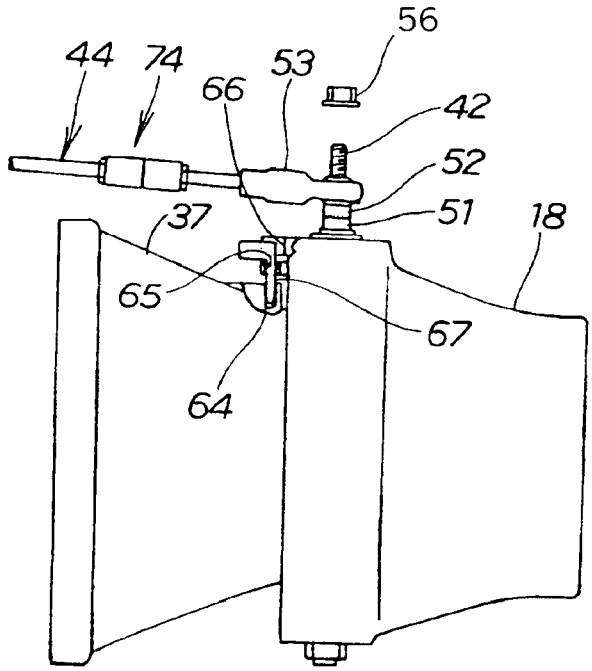

FIGS. 12(*a*) and (*b*) are fourth assembly step views for illustrating the process of assembling the steering nozzle onto the jet nozzle, in the personal watercraft according to the present invention.

In FIG. 12(*a*), the positioning pin 67 is inserted through the insertion groove 66 into the positioning hole 65, and the tip end of the positioning pin 67 protruding from the positioning hole 65 is inserted into the positioning recessed portion 64.

By this, the axis 68 of the steering nozzle 18 can be made to coincide with the axis of the jet nozzle 37, namely, with the axis 35 of the water jet propeller 17, and the direction of the steering nozzle 18 can be fixed in a standard position.

Thus, by the simple operation of just inserting the positioning pin 67 into the positioning hole 65 and the positioning recessed portion 64, the direction of the steering nozzle 18 can be fixed in the standard position. Therefore, the direction of the steering nozzle 18 can be adjusted to a normal angle in a laborsaving manner.

After the direction of the steering nozzle 18 is fixed into the standard position by inserting the positioning pin 67 into the positioning hole 65 and the positioning recessed portion 64, the trim joint 53 is fitted over the upper bolt 42. In this case, even if the length of the trim operating cable 44 has been adjusted in advance, it is necessary to readjust the cable length.

In performing the readjustment, the trim joint 53 once fitted over the upper bolt 42 is drawn out from the upper bolt 42, and is rotated as indicated by an arrow to thereby adjust the protrusion amount of the trim joint 53. By this, the length of the trim operating cable 44 can be adjusted.

Here, when the length of the trim operating cable 44 is adjusted by rotating the trim joint 53, for example, the mount hole 55 in the ball 54 of the trim joint 53 may come out of registration with the axis of the upper bolt 42.

In this case, the trim joint 53 can be rotated arbitrarily by use of the joint means 74 intermediately provided at an intermediate portion of the rod portion 73. Namely, by rotating the rear joint portion 77 of the joint means 74, the mount hole 55 in the ball 54 can be easily adjusted to the axis of the upper bolt 42.

In FIG. 12(*b*), after the length of the trim operating cable 44 is adjusted, the trim joint 53 is fitted over the upper bolt 42. Next, the nut 56 is screw-engaged with the upper bolt 42 projecting upwards from the trim joint 53, whereby the trim joint 53 is fixed to the upper bolt 42. By this, the adjustment of the length of the trim operating cable 44 is completed.

After the adjustment of the length of the trim operating cable 44 is completed, the positioning pin 67 is drawn out of the positioning hole 65 and the positioning recessed portion 64, thereby completing the process of assembling the steering nozzle 18.

Figure 13:
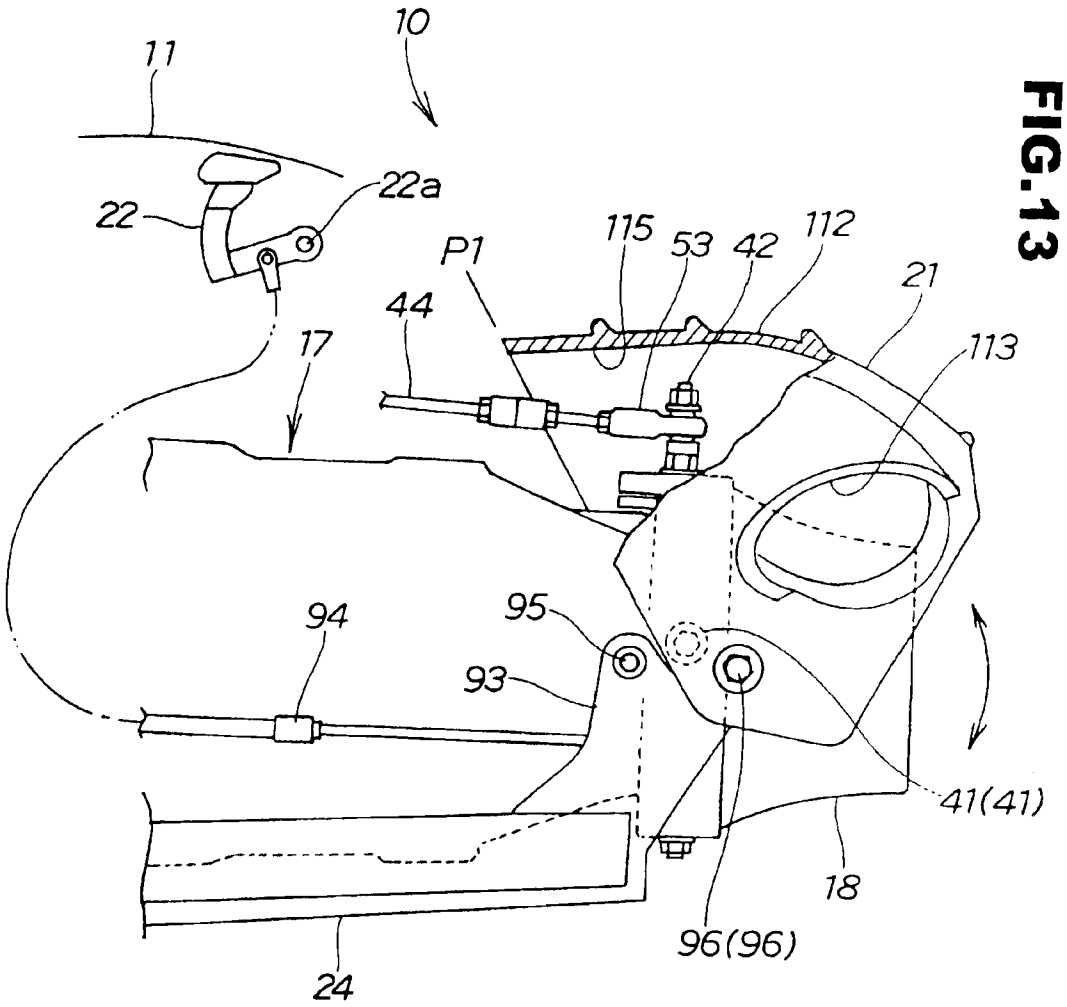
FIG. 13 illustrates the relationship between an upper bolt, a trim operating cable and a reverse bucket, in the personal watercraft according to the present invention.

Referring now to FIG. 13, the relationship between the upper bolt and the trim operating cable and the reverse bucket are illustrated.

By pressing back the reverse operating lever 22 downward from the condition of FIG. 6, with the support shaft 22*a* as a center, the reverse bucket 21 is raised from the reverse position P2 to the forward position P1.

Here, the personal watercraft 10 has a structure in which the steering nozzle 18 is vertically swung as indicated by arrows, with the left and right bolts 41, 41 as an axis.

For this reason, the upper bolt 42 is attached to an upper end portion of the steering nozzle 18, and the trim operating cable 44 is attached to the upper bolt 42 through the trim joint 53 and disposed along an upper portion of the stator 31.

Therefore, at the time of raising the reverse bucket 21 to the forward position P1, the rear wall 112 of the reverse bucket 21 may interfere with these members (the upper bolt 42, the trim joint 53 and the trim operating cable 44).

Taking this into account, the rear wall 112 of the reverse bucket 21 is provided with the connection portion containing recessed portion 115 for obviating the interference with these members (the upper bolt 42, the trim joint 53 and the trim operating cable 44).

With this structure, the rear wall 112 of the reverse bucket 21 can be prevented from interfering with the upper bolt 42 or the trim joint 53 when the reverse bucket 21 is raised to the forward position P1.

Figure 14A:
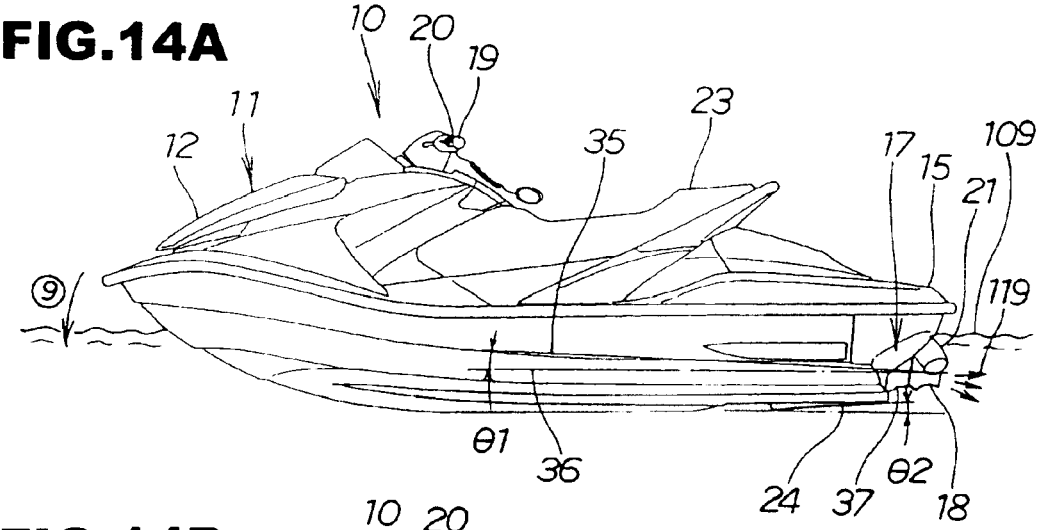
FIG. 14 illustrates the propulsion condition of the personal watercraft according to the present invention.
Figure 14B:
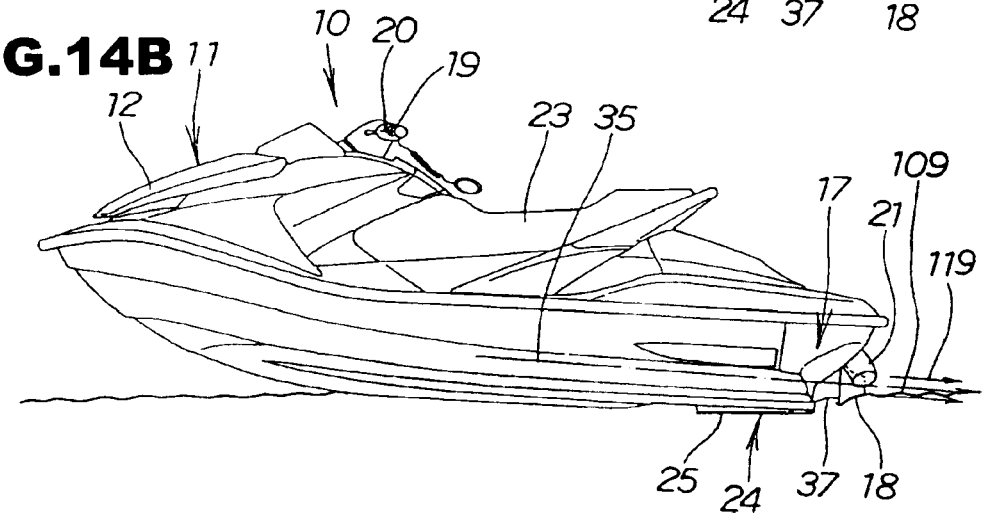
Figure 14C:
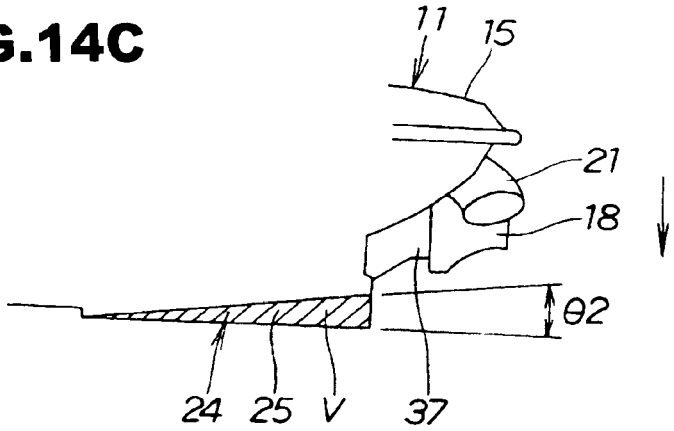

FIGS. 14(*a*) to (*c*) illustrate the propulsion condition of the personal watercraft according to the present invention.

Generally, a personal watercraft has the tendency that a front portion 12 of the hull 11 is floated up at the time of starting. Therefore, it is desired to put to practical use a personal watercraft 10 which can be started favorably without the floating-up of the front portion 12 (namely, the bow) of the hull 11.

In view of this, the axis 35 of the water jet propeller 17 has been set with a downward gradient at an angle θ1 toward the rear side of the hull 11, relative to the reference line 36 parallel to the horizontal line during planing. By this, the effect as shown in (a) is obtained.

In FIG. 14(*a*), at the time of starting the personal watercraft 10, the trim operating lever 20 (see FIG. 1 also) is gripped, to thereby turn the steering nozzle 18 downwards relative to the axis 35 of the water jet propeller 17.

By this, jet water 119 is jetted from the steering nozzle 18 downwards relative to the surface of water 109.

As a result, a force for floating up the stern 15 of the hull 11 is generated, tending to lower the front portion 12 of the hull 11 as indicated by arrow (9).

Therefore, at the time of starting the personal watercraft 10, the personal watercraft 10 can be started favorably without the floating-up of the front portion 12 of the hull 11.

In FIG. 14(*b*), with the jet force of jet water 119 increased, the personal watercraft 10 is put into a planing condition. With the personal watercraft 10 put into the planing condition, the front portion 12 of the hull 11 parts from the surface of water and the floating-up tendency is lost; therefore, the grip on the trim operating lever 20 (see FIG. 1 also) is released, thereby setting the steering nozzle 18 to be coaxial with the axis 35 of the water jet propeller 17.

By this, the force for floating up the stern 15 of the hull 11 can be reduced.

Here, as shown in FIG. 14(*c*), the personal watercraft 10 has a structure in which the bottom surface 25 of the ride plate 24 is set with the upward gradient at the angle θ2 toward the rear side of the hull 11, relative to the reference line 36 parallel to the horizontal line during planing, as shown in (a).

With the bottom surface 25 of the ride plate 24 set with the upward gradient at the angle θ2, the volume (the hatched portion) V can be reduced, as compared with the conventional ride plate. Accordingly, the buoyancy corresponding to the volume V can be reduced.

Therefore, the buoyancy on the stern 15 of the hull 11 can be reduced as compared with the buoyancy in the case of an ordinary hull, so that the stern 15 will sink more easily in the direction of the arrow.

Returning to FIG. 14(*b*), with the jet force of jet water 119 increased to put the personal watercraft 10 into the planing condition, the velocity of the personal watercraft 10 is increased, and the hull 11 tends to float up from the surface of water 109.

In this instance, the steering nozzle 18 coincides with the axis 35 of the water jet propeller 17 and has the downward gradient at the inclination angle θ1 relative to the horizontal line 36 (see FIG. 2). Therefore, a force for raising the stern 15 is generated.

Here, by setting the bottom surface 25 of the ride plate 24 with the upward gradient at the angle θ2, the stern 15 is made to be easier to lower. As a result, the front and rear portions of the hull 11 are favorably floated up from the surface of water 109, and the personal watercraft 10 can plane in a favorable posture.

Next, a second embodiment will be described.

Figure 15:
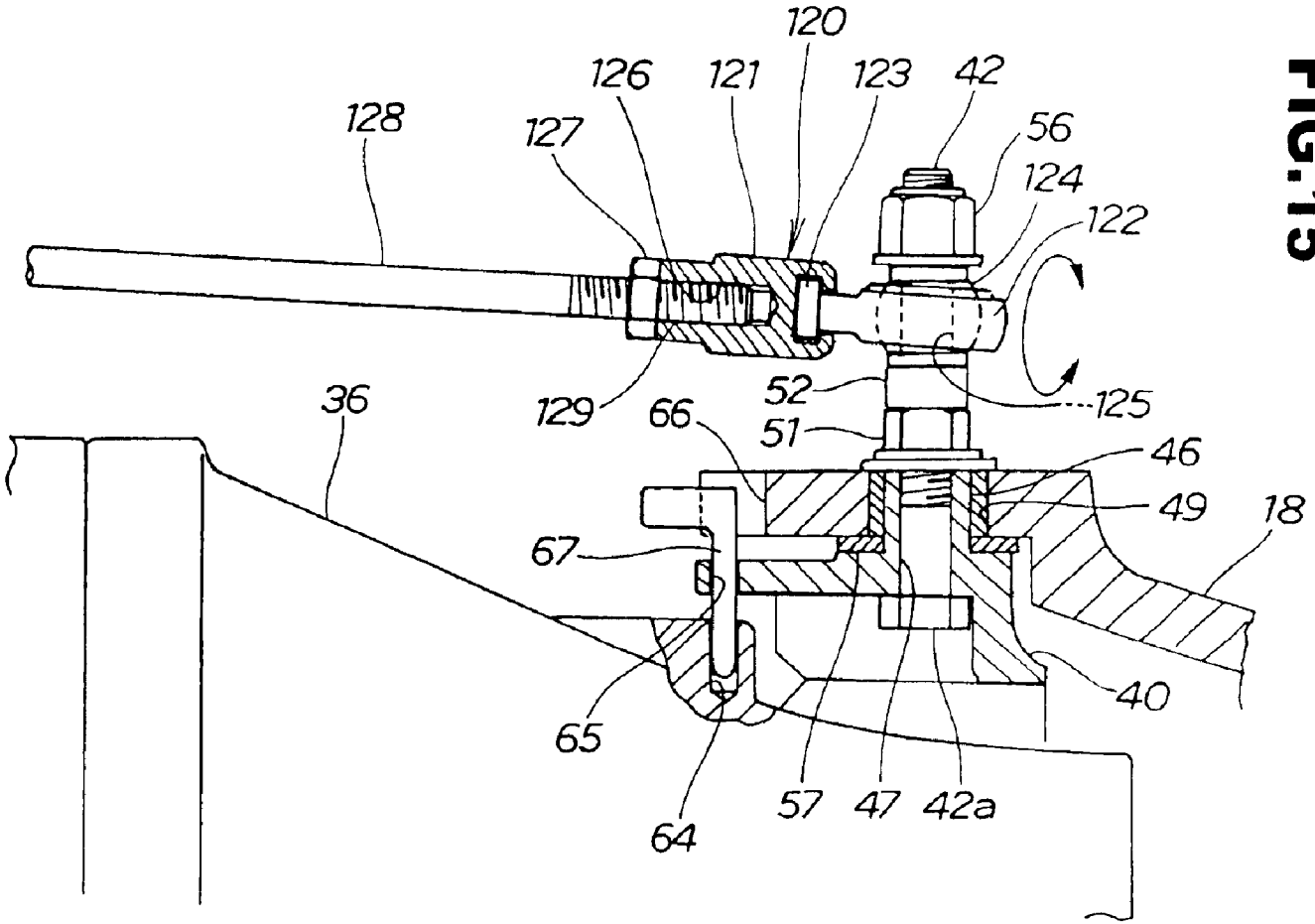
FIG. 15 is an enlarged view of a portion of a second embodiment of a personal watercraft according to the present invention.

FIG. 15 is an enlarged view showing the second embodiment of the personal watercraft according to the present invention. Incidentally, in the second embodiment, the same members as those in the first embodiment will be denoted by the same symbols as above and description thereof is omitted.

The upper bolt 42 is attached to the trim ring 40 and the steering nozzle 18 with the nut 51, and the spacer 52 is placed on the nut 51. In this condition, a trim joint (connection portion) 120 is attached to the upper bolt 42 protruding from the spacer 52.

The trim joint 120 includes a head portion 122 rotatably connected to a neck portion 121 through a flange 123. A mount hole 125 in a ball 124 provided in the head portion 122 is fitted over the upper bolt 42, and the nut 56 is screw-engaged with the upper bolt 42 from the upper side of the head portion 122, whereby the trim joint 120 is attached to the upper bolt 42.

The tip end 129 of a trim operating cable 128 is screw-engaged with a threaded hole 126 in the neck portion 121, and a lock nut 127 is tightened, whereby the trim operating cable 128 is connected to the trim joint 120.

At the time of readjusting the length of the trim operating cable 128, first, the trim joint 120 once fitted over the upper bolt 42 is drawn out from the upper bolt 42. Next, the lock nut 127 is slackened, and then the neck portion 121 is rotated to change the protrusion amount of the trim joint 120, thereby adjusting the length of the trim operating cable 128.

Here, when the length of the trim operating cable 128 is adjusted by rotating the trim joint 120, for example, the mount hole 125 in the ball 124 of the trim joint 120 may come out of registration with the axis of the upper bolt 42.

In such a case, by arbitrarily rotating only the head portion 122 under the condition where the neck portion 121 is held stationary, the mount hole 125 in the ball 124 can be easily adjusted to the axis of the upper bolt 42, whereby the mount hole 125 can be fitted over the upper bolt 42.

Thus, with the trim joint 120 according to the second embodiment, the same effect as that of the trim joint 53 according to the first embodiment can be obtained.

Incidentally, while an example of using the upper and lower bolts 42 and 43 as the upper and lower support shafts for mounting the steering nozzle 18 onto the trim ring 40 so as to be swingable in the left-right directions has been described in the above embodiment, the upper and lower support shafts are not limited to the bolts 42 and 43 and other members may also be used as the upper and lower support shafts.

The example embodiments of the personal watercraft configured as described herein can exhibit one or more beneficial aspects. For example, the upper and lower bolts used to swingable mount the trim ring and the steering nozzle so that, even if the upper and lower bolts should be slackened, the heads of the upper and lower bolts can be prevented from slipping off from the trim ring to the outside. By this, the upper and lower bolts can be prevented from dropping from the steering nozzle to the outside, so that the steering nozzle can be maintained in connection with the trim ring.

In addition, the axis of the steering nozzle can be fixed in the standard position so as to coincide with the axis of the jet nozzle by inserting the positioning pin into the through-hole formed in the trim ring and the recessed portion formed in the jet nozzle. Thus, the steering nozzle can be fixed in the standard position by the simple operation of just inserting the positioning pin into the through-hole and the recessed portion, so that the length of the operating cable can be adjusted in a laborsaving manner. Therefore, the time required for adjusting the direction of the steering nozzle can be shortened, thereby enhancing the productivity.

Further, the connection portion can be mounted onto the upper support shaft erected on the trim ring so as to be capable of being fitted over and drawn out, whereby the operating cable can be tentatively fixed to the upper support shaft by only fitting the connection portion over the upper support shaft. By this, in the tentatively fixed condition where the connection portion is fitted over the upper support shaft, it is possible to check whether or not the length of the operating cable is normal. Therefore, in the case where it is necessary to readjust the length of the operating cable, the connection portion can be easily disengaged from the upper support shaft. Accordingly, the length of the operating cable can be adjusted easily in a laborsaving manner. In addition, by connecting the operating cable by utilizing the upper support shaft, the structure can be simplified.

What is claimed is:

1. A personal watercraft comprising an engine and a jet propeller driven by said engine which are disposed in a hull, a jet nozzle for ejecting jet water which is disposed on a rear side of said jet propeller, an annular trim ring mounted onto a rear portion of said jet nozzle with left and right support shafts so as to be vertically swingable, and a steering nozzle mounted onto said trim ring with upper and lower support shafts so as to be swingable in left-right directions, whereby said steering nozzle is mounted onto said jet nozzle so as to be swingable vertically and in the left-right directions, wherein said upper and lower support shafts are upper and lower bolts, and said upper and lower bolts are mounted such that heads thereof are directed toward said jet nozzle, and a length of each of said upper and lower bolts is set so that said upper and lower bolts remain fastened to said steering nozzle when said heads of said upper and lower bolts come into contact with said jet nozzle.

2. The watercraft of claim 1, wherein the length of the upper bolt is greater than a gap between the trim ring and an adjacent surface of the jet nozzle.

3. The watercraft of claim 1, wherein the length of the upper bolt is greater than the length of the lower bolt.

4. The watercraft of claim 1, further comprising a nut fastened onto an end of the upper bolt opposite to the head, wherein upon loosening of the nut the head of said upper bolt comes into contact with said jet nozzle.

5. The watercraft of claim 1, wherein said jet nozzle defines a recessed portion, said trim ring defines a through-hole, and a positioning pin is insertable into said through-hole and said recessed portion, whereby an axis of said steering nozzle is made to coincide with an axis of said jet nozzle.

6. The watercraft of claim 5, wherein an insertion nozzle defines an insertion groove through which the positioning pin extends.

7. The watercraft of claim 1, further comprising an operating cable for swinging said steering nozzle vertically, and a connection portion of said operating cable is detachably retained on said upper support shaft on said trim ring.

8. The watercraft of claim 7, further comprising a joint means for adjusting a length of said operating cable.

9. A personal watercraft comprising an engine and a jet propeller driven by said engine which are disposed in a hull, a jet nozzle for ejecting jet water which is disposed on a rear side of said jet propeller, an annular trim ring mounted onto a rear portion of said jet nozzle with left and right support shafts so as to be vertically swingable, and a steering nozzle mounted onto said trim ring with upper and lower support shafts so as to be swingable in left-right directions, whereby said steering nozzle is mounted onto said jet nozzle so as to be swingable vertically and in the left-right directions, wherein said jet nozzle defines a recessed portion, said trim ring defines a through-hole, and a positioning pin is insertable into said through-hole and said recessed portion, whereby an axis of said steering nozzle is made to coincide with an axis of said jet nozzle.

10. The watercraft of claim 9, wherein the axis of the steering nozzle and the jet nozzle are each a central axis.

11. The watercraft of claim 9, wherein an insertion nozzle defines an insertion groove through which the positioning pin extends.

12. The watercraft of claim 9, wherein said upper and lower support shafts are upper and lower bolts, and said upper and lower bolts are mounted such that heads thereof are directed toward said jet nozzle, and a length of each of said upper and lower bolts is set so that said upper and lower bolts remain fastened to said steering nozzle when said heads of said upper and lower bolts come into contact with said jet nozzle.

13. The watercraft of claim 12, wherein the length of the upper bolt is greater than a gap between the trim ring and an adjacent surface of the jet nozzle.

14. The watercraft of claim 9, further comprising an operating cable for swinging said steering nozzle vertically, and a connection portion of said operating cable is detachably retained on said upper support shaft on said trim ring.

15. The watercraft of claim 14, further comprising a joint means for adjusting a length of said operating cable.

16. A personal watercraft comprising an engine and a jet propeller driven by said engine which are disposed in a hull, a jet nozzle for ejecting jet water which is disposed on a rear side of said jet propeller, an annular trim ring mounted onto a rear portion of said jet nozzle with left and right support shafts so as to be vertically swingable, and a steering ring mounted onto said trim ring with upper and lower support shafts so as to be swingable in left-right directions, whereby a steering nozzle is mounted onto said jet nozzle so as to be swingable vertically and in the left-right directions, wherein an operating cable is provided for swinging said steering nozzle vertically, and a connection portion of said operating cable is detachably retained on said upper support shaft on said trim ring, and wherein said upper and lower support shafts are upper and lower bolts, and said upper and lower bolts are mounted such that heads thereof are directed toward said jet nozzle, and a length of each of said upper and lower bolts is set so that said upper and lower bolts remain fastened to said steering nozzle when said heads of said upper and lower bolts come into contact with said jet nozzle.

17. The watercraft of claim 16, further comprising a nut that is threaded onto said upper support to retain the connection portion of said operating cable on said upper support.

18. The watercraft of claim 16, further comprising a joint means for adjusting a length of said operating cable.

* * * * *